US007641847B2

(12) United States Patent
Voice et al.

(10) Patent No.: US 7,641,847 B2
(45) Date of Patent: Jan. 5, 2010

(54) COMPONENT FORMING METHOD

(75) Inventors: Wayne E Voice, Nottingham (GB); Xinhua Wu, Birmingham (GB); Michael Loretto, Birmingham (GB)

(73) Assignee: Rolls-Royce plc, London (GB)

( * ) Notice: Subject to any disclaimer, the term of this patent is extended or adjusted under 35 U.S.C. 154(b) by 635 days.

(21) Appl. No.: 11/540,596

(22) Filed: Oct. 2, 2006

(65) Prior Publication Data

US 2007/0074841 A1 Apr. 5, 2007

(30) Foreign Application Priority Data

Oct. 4, 2005 (GB) ..... 0520133.0

(51) Int. Cl.
*B28B 3/00* (2006.01)
*B22D 29/00* (2006.01)

(52) U.S. Cl. ..... 264/604; 164/132

(58) Field of Classification Search ..... 264/604; 164/132

See application file for complete search history.

(56) References Cited

U.S. PATENT DOCUMENTS 1,523,519 A * 1/1925 Gibbons ..... 106/38.9
1,554,697 A * 9/1925 Alden ..... 264/317
2,217,734 A * 10/1940 Dreyfus ..... 264/275
4,389,367 A 6/1983 Hudson
4,840,219 A 6/1989 Foreman
7,112,301 B2 * 9/2006 Thorne et al. ..... 419/5
2005/0135958 A1 6/2005 Thorne

FOREIGN PATENT DOCUMENTS

JP 56114567 AB 9/1981
JP 60166158 AB 8/1985
JP 8020807 AB 1/1996
JP 2001335814 AB 12/2001

* cited by examiner

*Primary Examiner*—Carlos Lopez
*Assistant Examiner*—Russell J Kemmerle, III
(74) *Attorney, Agent, or Firm*—Jeffrey S. Melcher; Manelli Denison & Selter PLLC

(57) ABSTRACT

A component can be formed by a hot isostatic pressing (HIP) process but it is necessary to reinforce intricate internal structures against collapse and deformation by the hot isostatic pressing process. The present method utilizes a low melting point salt or alloy reinforcement within the structure which can be released when molten through a drain from the internal structure. The reinforcement may be molten as a result of the hot isostatic process or through achieving a temperature with the component which causes the reinforcement to become molten but without damaging the component itself. The remaining parts of the reinforcement may be removed by use of a solvent or simple washing with a corrosive agent to remove any reinforcement debris.

22 Claims, 1 Drawing Sheet

COMPONENT FORMING METHOD

Figure 1:
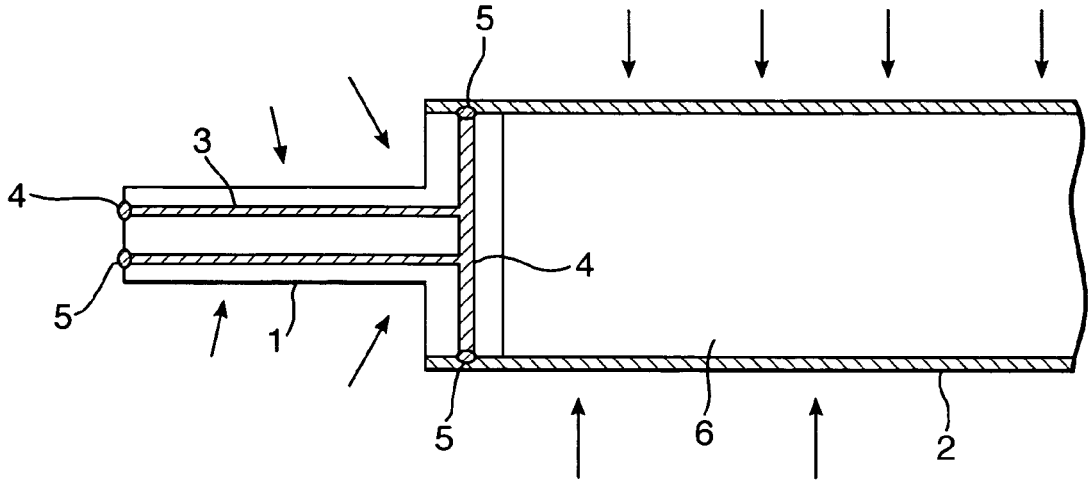

The present invention relates to methods of component-forming and, more particularly, to components having internal cavities, passages and holes.

It is necessary to form some components with internal structures and cavities to provide cooling or simply to reduce the weight of material used in the component whilst maintaining sufficient structural strength. A particular method of forming components utilises hot isostatic pressing (HIP) of metal alloy powders in order to create components. In short, the alloy powder is compressed uniformly at high temperature such that it fuses into the desired component shape. In order to create internal cavities, passageways and other structures previously a mould tool was utilised. This mould tool typically takes the form of mild steel or other metal which is sacrificially located within the alloy powder so that during the hot isostatic pressing process the mould tool is stable to allow the powder to be fused into its necessary shape.

Once the component has been formed by the hot isostatic pressing process it will be understood that it is then necessary to remove the mould tool. As described in U.S. Patent Publication Number 2005/0135958, this can be performed by leaching away the mould tool or core using an appropriate acid but this will be a time-consuming process. It will also be understood that it is necessary to provide a suitable acid to ensure that the mould tool is leached away without significantly damaging the objective component structure.

In accordance with the present invention, there is provided a component forming method for forming a component comprising (a) forming an internal structure and filling the internal structure with a reinforcement in the form of a salt to the internal structure and choosing the reinforcement to have a melting point achievable by heating the component without damage to the component;

(b) associating the internal structure with the remainder of the component by a forming process; and (c) removing the reinforcement by heating the reinforcement to a liquid state.

Possibly, the reinforcement is filled as a powder.

Advantageously the reinforcement includes an alloy formed for placement within the internal structure.

Typically, the internal structure is provided by forming a pre-form structure. Possibly the pre-form structure is drilled to provide access to the internal structure. Generally, the internal structure is closed with the reinforcement retained therein. Typically, closure is provided by a welding process. Possibly, the internal structure is formed as a box.

Generally, the internal structure is formed by cavities and/or passages and/or holes for the component.

Generally, the forming process is by hot isostatic pressing.

Typically, the internal structure is placed within a mould or other tool to allow association of the internal structure with the remainder of the component.

Typically, the remainder is initially presented in the mould as a powder.

Possibly, the mould is external to the component to allow erosion or scavenging removal after forming the component.

Typically, any remainder of the reinforcement is removed by a solvent wash.

Possibly, the reinforcement comprises calcium chloride. Possibly, the reinforcement is itself reinforced by a reinforcing member. Possibly, the reinforcing member comprises a mesh or ribbing secured in the internal structure. Typically, the reinforcing member is formed from a titanium alloy or nickel alloy. Generally, the reinforcing member remains after the reinforcement is removed.

Also, in accordance with the present invention, there is provided a component formed by a method as described above.

Typically, the component comprises an aerofoil blade. Possibly, the pre-form element provides the root to an aerofoil blade.

Embodiments of the present invention will now be described by way of example and with reference to the accompanying drawings in which:—

Figure 2:
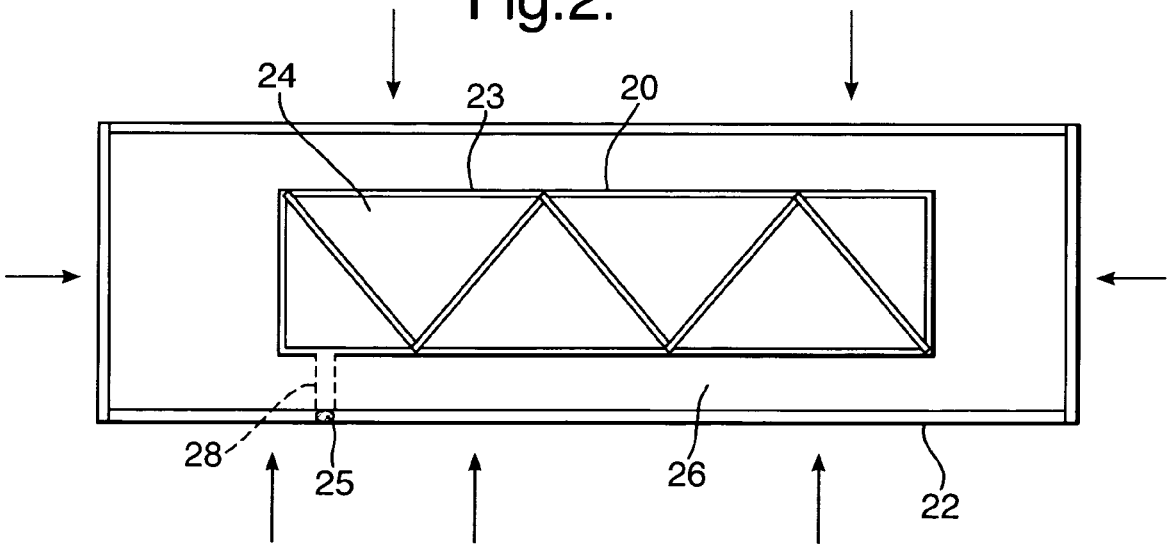

FIG. 1 is a schematic cross-section of a first application of a method in accordance with the present invention; and, FIG. 2 is a schematic illustration of a second application of a method in accordance with the present invention.

As indicated above, it is now intended to provide and form components using a hot isostatic pressing process. Such techniques are used to manufacture Ni alloy blisks by powder hot isostatic pressing and these blisks incorporate cooling holes in the form of an internal structure comprising holes, passages and/or cavities for use in the final component formed. The hot isostatic pressing process is used, but where it is desired to manufacture components with shaped internal cavities and structure, collapse and deformation of these internal structures must be prevented. It will be appreciated that these internal structures are relatively intricate and generally it is desirable to produce complex cavity structures such as strengthening features in the form of honeycomb and line-cores in fan blades as well cavities to accommodate sensors, instrumentation and functional mechanisms. In such circumstances the hot isostatic pressing process on its own or in association with other forming methods is useful to produce a wide range of components particularly for aero engines as well as industrial applications. In such circumstances these forming processes and techniques are desirable but the complexity of removing the moulding or forming tool used to protect and/or reinforce the internal structure during the forming process adds to complexity and cost. As indicated, generally these moulding tools and cores take the form of a metal, such as mild steel which must be removed by leaching using an acid or similar corrosive which takes time.

In the above circumstances, as indicated, the choices are between excessively long pickling times to leach remove a mild steel or similar material moulding tool or core or use of extensive post-forming machining in order to create internal holes/cavities as required and then subsequently sealing the surface through welding and smoothing.

Ideally, internal structures will be prevented from collapse during the hot isostatic processing in order to retain passages or otherwise in the structure subsequent to the hot isostatic processing procedure but without added complexity. Furthermore, the techniques should allow relatively complex internal structures to be formed in large components.

The present method fills the internal structure which requires reinforcement with an inherent relatively low melting point salt. This reinforcement is typically in the form of a powder. The melting point of the salt chosen will be such that when within a component it is possible to achieve the melting point of the salt by heating without damaging the component as formed. In short, the reinforcement is rendered molten by the heating and in such state it will be appreciated that through judicious drilling through to the internal structure it will be possible to remove the molten reinforcement as a fluid flowing through the drilled hole. In short, the low melting point salt or alloy reinforcement will run out of the formed component by heating above its melting temperature. In such circumstances, as the reinforcement is a salt then any remnant of the reinforcement remaining within the internal structure can be removed by injecting a solvent into the cavity or other internal structure until the solvent runs essentially clear indicating removal of the last remnants of the salt reinforcement.

It will be understood that melting at a low temperature means that the reinforcement if it remains within the internal structure, particularly if a cooling member within a gas turbine engine component, may lead to an agglomeration of the remnants of the reinforcement potentially causing blocking or degradation in the cooling flows through the passages. The remainder of the reinforcement must be removed.

FIG. 1 provides a schematic illustration of one application of a method in accordance with the present invention. Thus, a pre-form 1 in the form of an aerofoil blade is associated with a mild steel tool 2 filled with a metal alloy powder which will be utilised in order to create a mounting disc for the blade component 1. The blade component 1 incorporates an internal structure 3 comprising a plurality of passages, cavities and holes. It is protection of this internal structure 3 during the forming process and, in particular, the hot isostatic pressing process which is the requirement of a reinforcement 4 in accordance with the present method. As indicated above, this reinforcement 4 comprises a relatively low melting point salt. In order to fill the structure 3, it will be appreciated that this reinforcement salt will generally take the form of a fine powder which can be forced and compressed into the structure 3 in order to provide resistance to deformation and collapse under the hot isostatic pressing formation process. It will be understood that the reinforcement in such circumstances must be retained within the structure 3 during the hot isostatic pressing formation process so openings and holes in the structure 3 must be closed. This is achieved in the embodiment depicted in FIG. 1 through welds 5.

In the above circumstances it will be appreciated that the method involves tracing the pre-form 1 and filling the structure 3 within the pre-form 1 with the reinforcement 4 then sealing openings with welds 5. The pre-form is then presented to the mould 2 in the relationship depicted in FIG. 1. This assembly is then ready for hot isostatic pressing to form the final component. It will be understood that the hot isostatic pressing involves taking the pre-assembly depicted in FIG. 1 to a relatively high temperature and applying uniformly pressure about the component such that the powder 6 within the mould 2 becomes a solid alloy which is fused with the pre-form 1. The use of hot isostatic pressing allows different alloys to be formed to that of the metal of the pre-form 1.

As indicated above, the reinforcement may be loaded or placed in the pre-form 1 after that pre-form 1 is formed by a moulding or casting process. Alternatively, the internal structure may be formed by a lost wax process in a pre-mould which is then lined with an appropriate shell formation material which in turn is then filled with the salt reinforcement. The pre-mould is then eroded or otherwise removed to leave the internal structure comprising a shell with salt reinforcement within it. This internal structure can then be located in a further mould for the pre-form 1 to enable through a casting or other process formation of that pre-form with the internal structure therein. In such circumstances, the internal structure will be provided within the pre-form 1 and, as indicated, where necessary, holes closed with welds or otherwise. Once the hot isostatic pressing formation process has been performed, these closures or welds can be removed as indicated to allow the molten reinforcement to flow out of the internal structure or, if there are no holes, a hole drilled into the internal structure to allow the molten reinforcement to flow out and subsequently sealing that drilled hole with a weld or otherwise to restore component integrity.

Naturally, by a simple gravitational or forced flow process, it is generally not possible to remove all the reinforcement due to capillary and surface wetting retention of the molten reinforcement. In such circumstances, as the reinforcement is a salt, an appropriate solvent will be utilised in order to flush and wash the internal structure in order to remove remnants of the reinforcement. Additionally, or alternatively, a corrosive agent may be introduced to remove the remnants of the reinforcement. In either event, it will be appreciated that the heating process to cause the reinforcement to become molten should be such that achievement of the necessary temperatures or rendering the reinforcement molten does not cause damage to the component or the solvent or corrosive agent does not damage the final component at all or significantly.

It will be appreciated, in some circumstances it is desirably simply to produce an internal cavity within a component which may be of a relatively large size but which has limited, if any, intricacy or openings to an external surface. FIG. 2 provides a schematic illustration of a component formed according to a second aspect of the present invention. Thus, a pre-form is created by an alloy powder filling 26 within a mould tool 22. Within this pre-form a cavity 23 is defined by a reinforcing member 20 which generally takes the form of a rectangular box with web or rib or mesh reinforcement to provide compression strength for the member 20. A cavity 23 is filled with a salt reinforcement 24, as described previously. This reinforcement 24 is generally in the form of a powder which is compacted into the cavity 23 and about the member 20.

As indicated previously, the forming process utilising hot isostatic pressing will fuse the powder 26 in the mould 22 into a solid component. This hot isostatic pressing process, as described previously, applies equal pressure in the direction of arrow-heads A about the mould at high temperatures to cause the fusion of the alloy powder 26 in order to form the component with the cavity therein.

As indicated previously, once the powder 26 is fused the component will generally have sufficient temperature to allow the molten reinforcement within the cavity 23 to flow out of that cavity 23 if released. In such circumstances, in accordance with the second aspect of the invention depicted in FIG. 2, a drain hole 28 is drilled into the cavity 23 in order to release the molten reinforcement. As indicated, this may be immediately subsequent to hot isostatic pressing or the component may be heated subsequently to achieve a sufficient temperature to cause melting of the relatively low temperature reinforcement but without damage to the formed component 26.

The cavity 23 will generally still incorporate the reinforcement member 20 which may take the form of a steel structure. In such circumstances, in order to remove this structure, if desired, a corrosive or leaching solution may be introduced through the drain hole 28 into the cavity in order to erode and remove the member 20. It will also be understood, as described previously, a remnant of the reinforcement may remain within the cavity through wetting and other factors. In such circumstances, in order to remove this remnant of the reinforcement material a solvent or other washing material may be introduced into the cavity through the drain hole 28 to remove the remainder of the reinforcement. Once the cavity 23 is cleared of the remainder of the reinforcement, as well as the reinforcement member, if required, it will be understood that the drain hole 28 will be sealed through an appropriate weld 25.

It will be noted in both aspects of the present method described with regard to FIGS. 1 and 2, a mould 2, 22 is provided. This mould 2, 22 is generally external to the finally formed component. In such circumstances, this mould can be removed through an appropriate scavenge or erosion or dissolving process to leave the component exposed. In such circumstances, the mould 2, 22 would be sacrificial in a moulding process but in any event will generally have been distorted by the hot isostatic pressing process applied to this mould tool 2, 22.

As indicated above, cast components, particularly titanium alloys, are often hot isostatically pressed to remove internal porosity within the finally formed component. Nevertheless, these components will require internal structures for cooling pathways and other reasons including provision of cavities for instrumentation and sensors. The cavities in accordance with the present method are filled and sealed with a salt reinforcement to maintain the overall component shape during the hot isostatic pressing process. It will be understood that without the reinforcement of the salt reinforcement, these unsupported cavities and internal structures would at best become distorted and may collapse within the component form leading to failure and the scrapping of a component at a relatively late stage in manufacture.

Although use of powdered salts is described above with regard to the reinforcement within the internal structure, it is preferred to use salts. Salts provide the advantage that removal of the remaining salt after molten flow release can be easily achieved through introduction of an appropriate solvent in comparison with alloys which may be more difficult to remove requiring the use of pickling or corrosive agents. The preferred salt is calcium chloride which combines the necessary reinforcement properties for use within the internal structure with an appropriate low melting temperature for flow release and can be easily taken into and dissolved by a solvent for removal of the remainder of the salt reinforcement as required. Nevertheless, it will be appreciated that other salts may be used.

The present component-forming method will typically be utilised to form relatively high value components, typically titanium and nickel based alloy components used in gas turbine engines and, particularly, with regard to aerofoil blades and their mountings.

As indicated above, the salt reinforcement provided by the present invention will act during Hot Isostatic Pressing (HIPPING) to form a component. However, subsequent to forming the component must also be significantly robust for its purpose so as illustrated in FIG. 2 reinforcing members 20 may be provided which remain after removal of the salt reinforcement. These reinforcing members 20 may be formed from a titanium alloy for a titanium alloy component or nickel alloy for a nickel alloy component or otherwise suitable or acceptable combinations. The reinforcing members would not necessarily be removed/dissolved with the salt reinforcement. It will also be understood that the reinforcing member may have the same composition or similar composition to the metal powder used to form the component by Hot Isostatic Pressing. Thus, more robust materials may be used to the reinforcing member or a material not suitable of Hot Isostatic Pressing.

Whilst endeavouring in the foregoing specification to draw attention to those features of the invention believed to be of particular importance, it should be understood that the Applicant claims protection in respect of any patentable feature or combination of features hereinbefore referred to and/or shown in the drawings, whether or not particular emphasis has been placed thereon.

We claim:

1. A method for forming a component comprising:

(a) forming a preform, providing an internal structure in the preform, filling the internal structure with a reinforcement, the reinforcement comprising a salt, the salt having a low melting point;

(b) associating the preform with a mould, filling the mould with a powder;

(c) applying pressure and high temperatures to fuse the powder to form a component within the mould; and (d) removing the salt by heating the salt to a liquid state without damage to the component wherein step (c) comprises hot isostatic pressing.

2. A method as claimed in claim 1 wherein the salt reinforcement comprises a powder.

3. A method as claimed in claim 1 comprising drilling the preform to provide access to the internal structure.

4. A method as claimed in claim 1 comprising closing the preform with the reinforcement retained therein.

5. A method as claimed in claim 4 wherein the preform is closed by a welding process.

6. A method as claimed in claim 1 comprising forming the preform as a box.

7. A method as claimed in claim 6 wherein the preform is itself reinforced by a reinforcing member.

8. A method as claimed in claim 7 wherein the reinforcing member comprises a mesh or ribbing in the preform.

9. A method as claimed in claim 7 wherein the reinforcing member is formed from a titanium alloy or a nickel alloy.

10. A method as claimed in claim 7 wherein the reinforcing member remains after the salt is removed.

11. A method as claimed in claim 1 wherein the internal structure of the preform is formed by cavities and/or passages and/or holes for the component.

12. A method as claimed in claim 1 wherein the preform is placed within a mould to allow association of the internal structure with a remainder of the component.

13. A method as claimed in claim 1 wherein the mould is external to the component, and removing the mould from the component after forming the component.

14. A method as claimed in claim 1 comprising removing a remainder of the salt by a solvent wash.

15. A method as claimed in claim 1 wherein the salt comprises calcium chloride.

16. A method as claimed in claim 1 wherein the preform comprises an aerofoil blade.

17. A method as claimed in claim 16 wherein the preform provides a root to an aerofoil blade.

18. A method as claimed in claim 16 wherein the mould provides a mounting disc for the aerofoil blade.

19. A method as claimed in claim 16 wherein the preform has been cast.

20. A method as claimed in claim 1 wherein the powder is a metal powder.

21. A method as claimed in claim 1 wherein the metal powder is selected from the group comprising titanium powder and nickel powder.

22. A method for forming a component comprising:

(a) forming a preform, providing an internal structure in the preform, the internal structure being defined by at least one cavity, filling the internal structure with a reinforcement, the reinforcement comprising a salt, the salt having a low melting point;

(b) associating the preform with a mould, filling the mould with a powder such that the powder contacts the preform;

(c) applying hot isostatic pressure to fuse the powder within the mould and to fuse the powder within the mould to the preform to form a component; and (d) removing the salt by heating the salt to a liquid state without damage to the component.

* * * * *

UNITED STATES PATENT AND TRADEMARK OFFICE

CERTIFICATE OF CORRECTION

PATENT NO. : 7,641,847 B2
APPLICATION NO. : 11/540596
DATED : January 5, 2010
INVENTOR(S) : Voice et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 730 days.

Signed and Sealed this

Sixteenth Day of November, 2010

David J. Kappos

David J. Kappos
*Director of the United States Patent and Trademark Office*